US005263767A

United States Patent [19]

Asbjφrnsen et al.

[11] Patent Number: 5,263,767

[45] Date of Patent: Nov. 23, 1993

[54] ADJUSTABLE CHAIR

[75] Inventors: Svein Asbjφrnsen, N-6230; Jan Lade, both of Sykkylven, Norway

[73] Assignees: Svein Asbjφrnsen; Jan Lade A/S, both of Sykkylven, Norway

[21] Appl. No.: 678,980

[22] PCT Filed: Feb. 28, 1990

[86] PCT No.: PCT/NO90/00040

§ 371 Date: Apr. 26, 1991

§ 102(e) Date: Apr. 26, 1991

[87] PCT Pub. No.: WO91/12750

PCT Pub. Date: Sep. 5, 1991

[51] Int. Cl.[5] ..... A47C 1/032

[52] U.S. Cl. ..... 297/320; 297/378.12; 297/361.1

[58] Field of Search ..... 297/301, 316, 320, 328, 297/355, 361, 319

[56] References Cited

U.S. PATENT DOCUMENTS

| | | | |
|---|---|---|---|
| 2,321,385 | 6/1943 | Herold . | |
| 2,324,902 | 7/1943 | Benzick . | |
| 2,859,799 | 11/1958 | Moore | 297/316 X |
| 4,629,249 | 12/1986 | Yamaguchi | 297/316 X |
| 4,640,547 | 2/1987 | Fromme | 297/320 X |
| 4,682,814 | 7/1987 | Hansen | 297/316 X |
| 4,718,725 | 1/1988 | Suhr et al. | 297/328 X |
| 4,877,291 | 10/1989 | Taylor | 297/34 |

FOREIGN PATENT DOCUMENTS

| | | | |
|---|---|---|---|
| 0263323 | 9/1987 | European Pat. Off. . | |
| 1099705 | 10/1956 | Fed. Rep. of Germany | 297/316 |
| 2026929 | 12/1970 | Fed. Rep. of Germany . | |

*Primary Examiner*—Peter R. Brown
*Attorney, Agent, or Firm*—Ladas & Parry

[57] ABSTRACT

An adjustable chair in which the mutual angle between seat (1; 1') and backrest (2; 2') may be changed, with a stationary fixture (3; 3') provided at each of the side-pieces of the chair, with seat (1; 1') being mounted to be tiltable about a fixed point (4; 4') on the fixture and with backrest (2; 2') being mounted to be tiltable about a fixed rear point (5; 5') on fixture (3; 3'). Below said rear fixed point a spigot (12; 12') projects laterally from the lower portion of the backrest and is designed to slide in a slide groove (11; 11') which slopes rearwards, downwards in a side piece (25; 25') of seat (1; 1'). At least one mechanism (7, 8; 7', 8') of optionally adjustable length forms the connection between a mounting point (6, 6') of said fixture (3, 3') and a lower point (9, 9') of the backrest for activation of said mechanism to cause movement of the spigot in said slide groove. When the backrest is moved backwards the rear edge of the seat will tilt downwards, and when the backrest is moved forwards the rear edge of the seat will tilt upwards.

10 Claims, 3 Drawing Sheets

ADJUSTABLE CHAIR

The present invention relates to an adjustable chair the seat and backrest of which are movable relative to each other on a common fixture at the side pieces of the chair, with movement between seat and backrest, at the same time, being controlled by a pin in a guiding groove, the seat being mounted to be tiltable about a fixed point on the fixture.

Numerous designs are known of adjustable chairs of the mentioned kind in which the mutual angle may be changed. Generally, however, tilting of the backrest backwards will cause the rear portion of the seat to be moved upwards. This will cause back rest cushions which are preset for an upright position of the backrest, to move out of their correct position relative to the person sitting in the chair when the backrest is moved backwards. This will require resetting of the backrest cushions in the tilted-back position which may, obviously, create certain problems. In a reclining position, it is also most comfortable to the user of the chair that the seat is also tilted slightly backwards. In most ordinary chairs the seat is, however, tilted to approach a horizontal position, and the user may easily slip off the chair or the chair will, at best, be perceived as being less comfortable to sit in.

According to the invention an adjustable chair of the above mentioned kind is thus proposed, the characterizing features of which appear from the following claims, as well as from the following disclosure with reference to the accompanying drawings.

Figure 2:
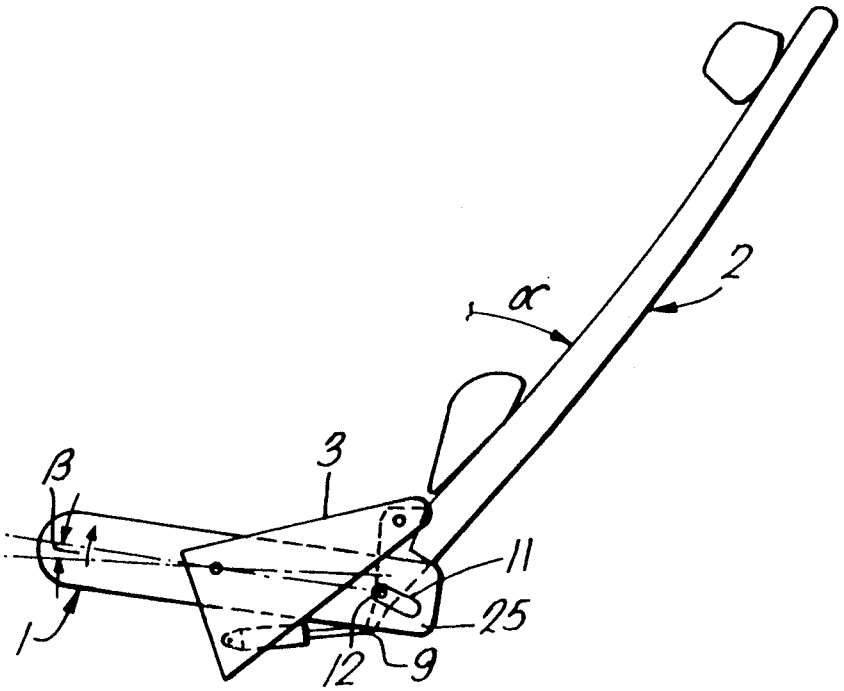
FIG. 2 shows the chair with its backrest in a tilted-back position.

The chair comprises a seat 1 and a backrest 2 which are mutually connected, partly via stationary fixtures 3 (only one shown) on opposite side support pieces (not shown) of the chair, and pins 12 (only one shown) which project laterally from the lower portion of opposite sides of the backrest and enter respective slide grooves 11 (only one shown) on lateral members 25 (only one shown) on opposite sides of the enter respective seat at its rear portion. Said slide groove 11 is provided at an angle with the longitudinal axis of the seat, i.e. inclined rearwards and downwards.

Figure 1:
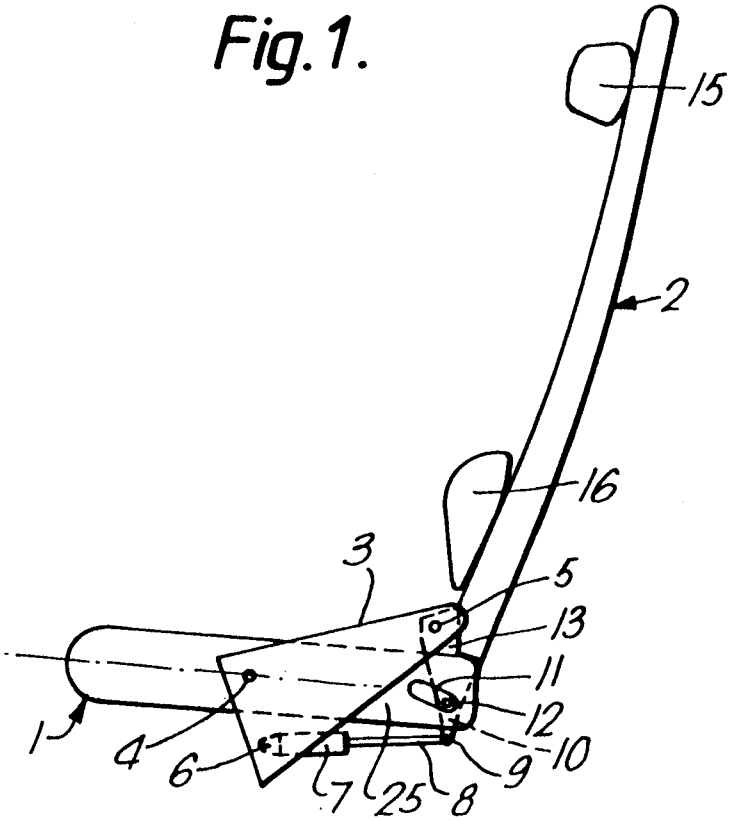
FIG. 1 shows the chair with its backrest in an upright position.

At its lower portion, the opposite sides of the backrest 2 are respectively provided with fixtures 13 (only one shown) the upper ends of which are respectively pivotally mounted at points 5 (only one shown) to the above mentioned stationary fixtures 3. Lowermost 10 on each back rest fixture 13 there is a fastening point 9 for a mechanism 7, 8 of optionally adjustable length, in the preferred embodiment a gas spring which may also optionally be locked in a desired position. In the shown embodiment piston rod 8 of the gas spring is rotatably connected with said fastening point 9, whereas the end of cylinder 7 is rotatably connected with a fastening point 6 on fixture 3. Fastening point 6 is indicated in FIGS. 1 and 2 at a short distance behind and below the tilting point 4 of seat 1 relative to fixture 3. The backrest is provided with a headrest and a cushion backrest 15, 16, although the number of cushions is here only intended to be an example and not to limit the invention.

When backrest 2 is moved rearwards at an angle $\alpha$ upon actuation of gas spring 7, 8 for relative movement of cylinder and piston rod, each pin 12 will be moved from the rear edge of slide groove 11 to the front edge of slide groove 11. At the same time the rear edge of the seat will tilt down and cause the seat proper to tilt at an angle $\beta$ in a rearward direction. The advantage is thus achieved that cushions 15, 16 will remain at a correct position relative to the user, and that the user will at the same time experience a more comfortable sitting position since the seat is also moved slightly rearwards.

In the shown embodiment an especially simple tilting mechanism is achieved in connection with an adjustable chair.

Being quite conventional, the means of actuating said gas spring 7, 8 are not shown in the drawing.

It will be obvious that there is no need for more than one gas spring, e.g. centrally provided under the chair. However, it is also possible to provide one gas spring at each side piece. Also, it is not required that pin 12 and slide grooves 11 are provided at the side pieces of the chair, they may rather be provided approximately midway between the side pieces of the chair.

Figure 5:
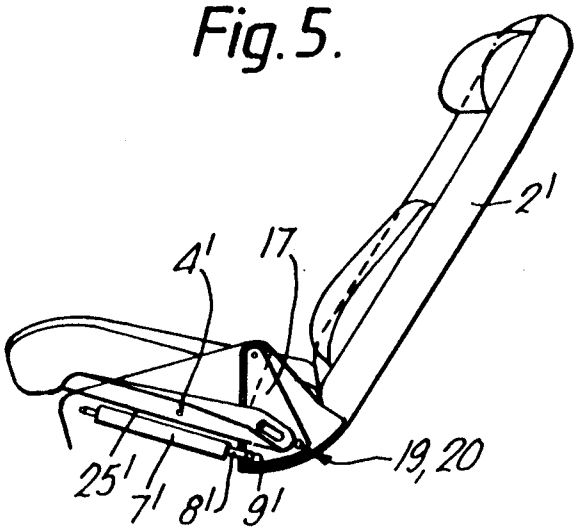
FIG. 5 shows the chair of FIGS. 3 and 4 in a tilted-back position.
Figure 4:
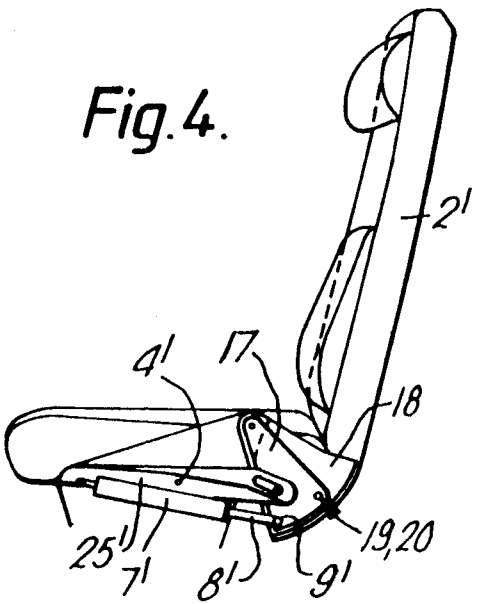
FIG. 4 shows the chair of FIG. 3 in an upright position.
Figure 3:
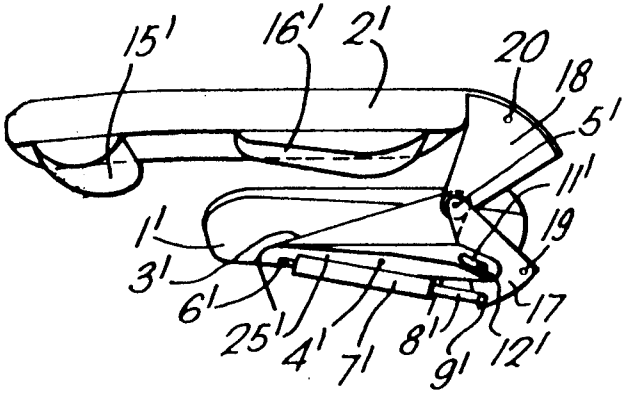
FIG. 3 shows a modified version of the chair of FIGS. 1 and 2 in a folded position.

In FIGS. 3–5 fixture 3 is shown in a design slightly differing from that shown in FIGS. 1 and 2. It will appear, inter alia, that fastening point 6' of cylinder 7' is placed in front of and slightly beneath tilting point 4' of the seat 1' relative to fixture 3'. Furthermore, the lowermost portion of the backrest comprises two cooperating members 17 and 18. In the shown embodiment member 17 is substantially shaped like a circle sector and its pointed end is pivotally mounted at a point 5' on stationary fixture 3'. Member 17 is provided with a pin 12' in slidable engagement with a slide groove 11' which is inclined downwards and rearwards in a side member 25' of seat 1'. The end of piston rod 8' of the gas spring is secured to member 17 at a point 9'. The other cooperating member 18 is also shaped like a circle sector and is at its pointed end pivotally mounted at point 5'. Backrest 2' is firmly mounted to member 18 so as to be turnable about point 5' of fixture 3'. Members 17 and 18 are provided with engaging members 19 and 20, respectively, e.g. pins to prevent member 18 with its spigot 20 from turning beyond pin 19.

When backrest 2' is, thus, tilted backwards from the position of FIG. 3, its movement will be checked by engagement of the pins 19 and 20. Further backward tilting of backrest 2' occurs by activation of gas spring 7', so that point 9' on member 17 approaches gas spring cylinder 7'. The pin 12' in slot 11' will then move to upper end of slot 11' causing the rear edge of seat 1' to tilt downwards—and at the same time the front edge of seat 1' to tilt slightly upwards—about tilting point 4'.

Obviously, fixture 3', side member 4' of seat, slot 11', member 17 with the pin 12' and 19, as well as member 18 with the pin 20 are present on both sides of the chair. It will also be understood that what is shown in FIGS.

4 and 5 has exactly the same mode of operation as in FIGS. 1 and 2, apart from the difference of mechanical build.

Figure 7:
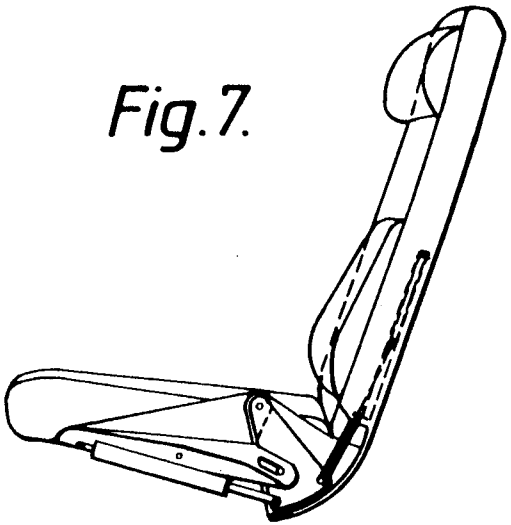
FIG. 7 shows the chair of FIG. 6 in an upright position.
Figure 6:
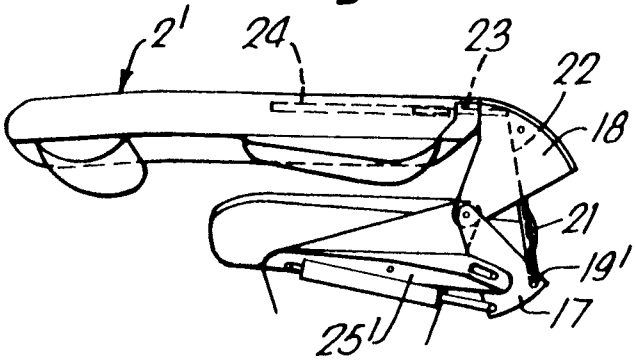
FIG. 6 shows the chair of FIGS. 3–5 in another modified version, in a folded position.
Figure 8:
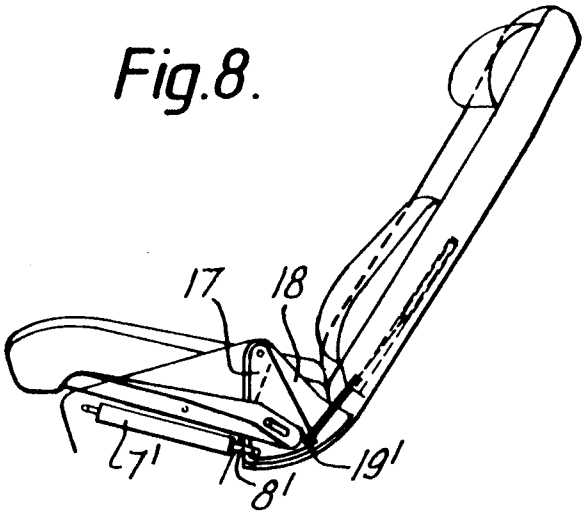
FIG. 8 shows the chair of FIGS. 6 and 7 in a first tilted-back position.

In FIGS. 6–9 another modification of the embodiment of FIGS. 3–5 is shown. The mode of operation of the embodiments in FIGS. 6–8 is basically the same as for what is shown in FIGS. 3–6, apart from the fact that pins 19 and 20 are no longer active, cooperation of member 17 and backrest 2' with member 18 now being adjusted by a gas spring 21, 22 cooperating with slide 23 and slide-loading spring 26 in a groove 24 in backrest 2'.

In FIG. 6 the gas spring is shown with its piston rod 22 completely extended and forming the connection with a free end of slide 23. The other end of the gas spring, the free end of cylinder 21, is pivotally mounted on member 17 at a point 19'. Due to the rotatable connection between slide 23 and rod 22, bracket 2' may be turned when the gas spring is operated. The slide will move upwards along groove 24 when the angle between the rod 22 and a longitudinal sliding axis of the slide 23 has passed a critical angle or dead point.

With the backrest in an upright position (FIG. 7) and with the gas spring locked, slide 23 will be at the bottom of groove 24. Backrest 2' is, thus, localized relative to seat 1'. In FIG. 8, the relation between seat 1' and backrest 2' is as shown in FIG. 5, since only gas spring 7', 8' is operated, so that the rear edge of seat 1' is tilted down at the same time as backrest 2' is tilted backwards. Thus, FIG. 7 corresponds to FIG. 4 and FIG. 8 corresponds to FIG. 5 with respect to the mutual angles between the seat 1' and backrest 2'.

Figure 9:
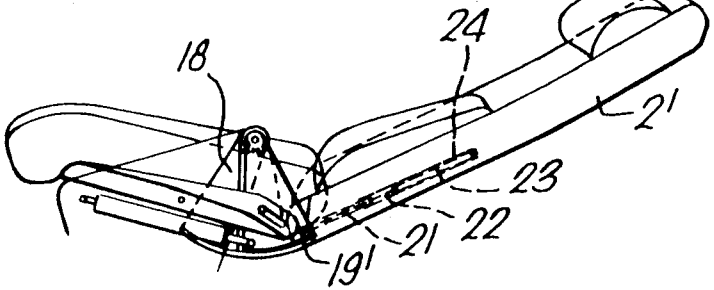
FIG. 9 shows the chair of FIGS. 6–8 in a second tilted-back position.

In FIG. 9 it is shown how backrest 2' may be caused to take a still more backwards tilted position than the position shown in FIG. 8. This occurs by operating gas spring 21, 22 to make rod 22 move into cylinder 21 causing gas spring 21, 22 to extend approximately flush with slide 23.

By the aid of the above indicated concepts of turning seat and backrest of the chair, the user's lumbar region and neck will remain at the same points relative to the backrest in an upright sitting position and all the way to a reclined sitting position.

We claim:

1. An adjustable chair, a backrest (2; 2') and a seat (1;1') of which are mounted to be movable relative to each other on a common fixture (3;3') at the sides of the chair, at the same time as movement between seat and backrest is controlled by a pin (12; 12') in a guiding groove (11; 11') said seat (1;1') being mounted to be tiltable about a fixed point (4;4') on said fixture (3;3'), characterized in that said fixture (3; 3') is firmly connected with the chair support, that said backrest (2; 2') is mounted at its lower portion (13; 17, 18) to be tiltable about a fixed top rear point (5; 5') on said fixture (3; 3'), that said pin (12; 12') projects laterally from the lower portion (10; 17) of the backrest below said top rear point (5; 5'), said pin (12; 12') being designed to slide in said guiding groove (11; 11'), said guiding groove (11, 11') being inclined rearwards and downwards in a side piece (25; 25') of said seat (1; 1'), that at least one mechanism of optionally adjustable length (7, 8; 7', 8') forms a connection between a mounting point (6, 6') on said fixture (3; 3') and a lower point (9, 9') of the lower portion (10, 13; 17) of the backrest and, by activation of said mechanism causes said pin (12; 12') to move in said guiding groove (11; 11') so that the rear edge of the seat (1; 1') will tilt downwards when said backrest (2; 2') is guided backwards and the rear edge of the seat is tilted upwards when the backrest is moved forwards.

2. An adjustable chair as stated in claim 1, characterized in that the mutual angle between said seat and backrest is lockable in extreme positions thereof and between such positions by said mechanism.

3. An adjustable chair as stated in claim 1, characterized in that said mounting point (6, 6') is placed at a level vertically below said fixed point (4, 4').

4. An adjustable chair as stated in claim 3, characterized in that said mounting point (6) is located rearwardly and below said fixed turning point (4).

5. An adjustable chair as stated in claim 3, characterized in that said mounting point (6') is located in front of said fixed turning point (4').

6. An adjustable chair as stated in claim 1, characterized in that said pin (12, 12') is located at a level between said top rear point (5, 5') and said lower point (9, 9').

7. An adjustable chair as stated in claim 1, characterized in that said lower portion of said backrest (2') comprises first and second members (17, 18), that said members (17, 18) are essentially circle sector shaped and at their pointed ends are mounted to be turnable about said top rear point (5') on said fixture (3'), said first member being provided with said pin (12') which is to slide in said guiding groove (11'), and said second member (18) being firmly connected with said backrest (2') at said lower portion thereof, and that said members are pivotally interconnected at said top rearpoint.

8. An adjustable chair as stated in claim 7, characterized in that relative engagement of said members is achieved by providing said first member (17) with a first engagement means (19), and providing said second member (18) with a second engagement means (20), said first and second engagement means being designed to limit maximum relative turning of said first and second members and, thus, a maximum angle between said backrest and seat.

9. An adjustable chair as stated in claim 7, characterized in that relative engagement between said members (17, 18) is achieved by providing said first member (17) with a mechanism (21, 22) of adjustable length which is directed upwards towards the back rest and at its upper free end (22) is connected in an articulated manner with a slide (23) which is provided to be slidable in a groove (24) of said backrest.

10. An adjustable chair, comprising:

a seat (1, 1');

a backrest (2, 2') at an upward and rearward portion of the seat;

a pin (12, 12') on a lower portion of the backrest laterally projecting into a guiding groove (11, 11') on the seat for sliding in the guiding groove, the guiding groove extending downwardly rearwardly, a fixture (3, 3') for fixing to a support for the chair;

first means (4, 4') tiltably mounting the seat on the fixture at a first point;

second means (5, 5') tiltably mounting the lower portion of the backrest on the fixture at a second point that is upward and rearward of the first point and upward of the pin;

adjustable-length means (7, 8; 7' 8') connected at one end to the lower portion of the backrest at a lower point that is downwards of the second point and connected at an opposite end to the fixture for adjusting in length and causing the pin to slide in the guiding groove when the seat and backrest are tilted about the first and second points, whereby the rearward portion of the seat tilts downward when an upper portion of the backrest is moved rearwards, and vice versa.

* * * * *